United States Patent [19]

Stiles et al.

[11] 4,204,286

[45] May 27, 1980

[54] SPRING SUPPORT

[75] Inventors: Nathan Stiles, Ashburnham; Richard T. Heininger, Gardner, both of Mass.

[73] Assignee: Gem Industries Inc., Gardner, Mass.

[21] Appl. No.: 968,077

[22] Filed: Dec. 11, 1978

[51] Int. Cl.[2] ..... A47C 17/14

[52] U.S. Cl. ..... 5/11; 5/285; 211/208; 312/351

[58] Field of Search ..... 312/185, 351; 211/207, 211/208; 3/11, 63, 100, 285

[56] References Cited

U.S. PATENT DOCUMENTS

| | | | |
|---|---|---|---|
| 2,641,772 | 6/1953 | Cook | 5/11 |
| 3,844,416 | 10/1974 | Patler | 211/208 |

*Primary Examiner*—Casmir A. Nunberg

*Attorney, Agent, or Firm*—Charles R. Fay

[57] ABSTRACT

A spring support comprising angle irons at each end of the spring to which the spring is secured, each angle iron having its ends formed with a relatively deep recess for a relatively short length in one angle iron flange and a shallower recess for a longer length in the other flange of the angle iron for engagement with a selected hook on a crib spring support plate or selectively on an inturned tab on the plate.

2 Claims, 8 Drawing Figures

SPRING SUPPORT

BACKGROUND OF THE INVENTION

The adjustable supports for crib springs has taken many forms and in the past the main considerations were to provide for ease of operation during the adjustment and inexpensiveness of manufacture. Crib springs were held in place by wire handles connected into the post bracket hooks and into the crib spring itself. In recent years to these considerations has been added that of particular safety to the occupant of the crib; and it is the object of the present invention to provide a very simple, easily operated, and safe crib spring support which is used in combination with a plural hook plate applied to the corner posts. This invention eliminates the need of the wire handles and elminates sharp and unsafe corners found on previously developed springs of this type.

SUMMARY OF THE INVENTION

In this case the usual four hook plate on the corner posts of the crib or any bedstead is replaced by a plate having three or only two hooks, but including the usual inturned tab at the bottom end of the plate, said tab being apertured for the reception of the drop rod of a drop side and in this invention serving as one of the adjustment positions for the spring support.

The spring support comprises an ordinary angle iron which has a horizontal top flange apertured to receive the springs, the side angles of the spring, and corner brackets. This flange has a recess at each end thereof which are relatively deep, extending almost to the vertical flange, but for a relatively short distance which approximates the distance between the hooks on the two corresponding hook plates at one end of the crib. The vertical flange also has a recess preferably with a rounded end to protect hands, this recess being longer than the first-named recess and shallower, and corresponding with the distance between the inwardly directed tabs on two corresponding hook plates, so that the crib spring may rest on the tabs or on a selected hook on the hook plate to provide an easy and safe adjustment while at the same time providing a very inexpensive device. With this construction, lateral and longitudinal motion of the spring is obviated.

PREFERRED EMBODIMENT OF THE INVENTION

Figure 1:
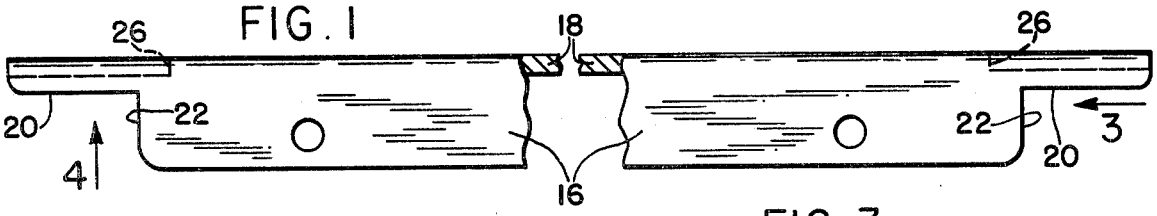
FIG. 1 is a plan view of one of the angle irons.

Crib and bedstead springs and crib and bedstead spring supports are, of course, well-known in the art.

Most of the prior art has used separable handles which are fairly easy to use but are expensive. In this invention there is a single angle iron at each end of the crib spring, the same being formed at the ends for adjustment purposes with regard to the hook plate which is indicated by the reference numeral 10 mounted on a corner post 12.

The hook plate may have two or more hooks, it being believed that only two hooks are necessary because of the construction of the present invention, these hooks being alike as indicated by the reference character 14.

Each angle iron comprises the horizontal flange 16 and vertical flange 18, the flange 16 being apertured at intervals for receiving springs, longitudinal side pieces for the spring, etc. as is well-known in the art.

Figure 2:
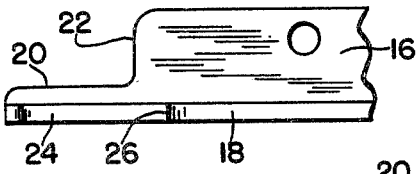
FIG. 2 is a bottom plan view of one end of the angle iron.
Figure 3:
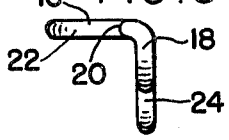
FIG. 3 is an end view looking in the direction of arrow 3 in FIG. 1.
Figure 4:
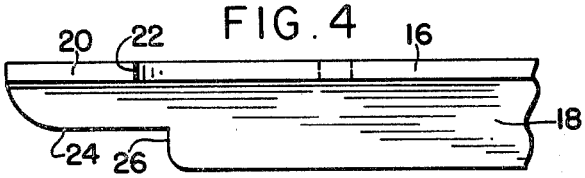
FIG. 4 is a side view looking in the direction of arrow 4 in FIG. 1.

In this case the horizontal flange 16 has a recess generally indicated at 20 and this extends to an edge 22 for a purpose to be described. The vertical flange 18 is provided with a recess at 24 extending to an edge 26 which is farther inwardly from the edge 22 as is clearly shown in FIGS. 2 and 4, for instance, and both ends of the angle iron are the same but reversed as is clearly shown in FIG. 1. It is to be particularly noted that the recess 24 is shallower than the deeper recess 20 but the recess 24 is longer than the recess 20.

Figure 5:
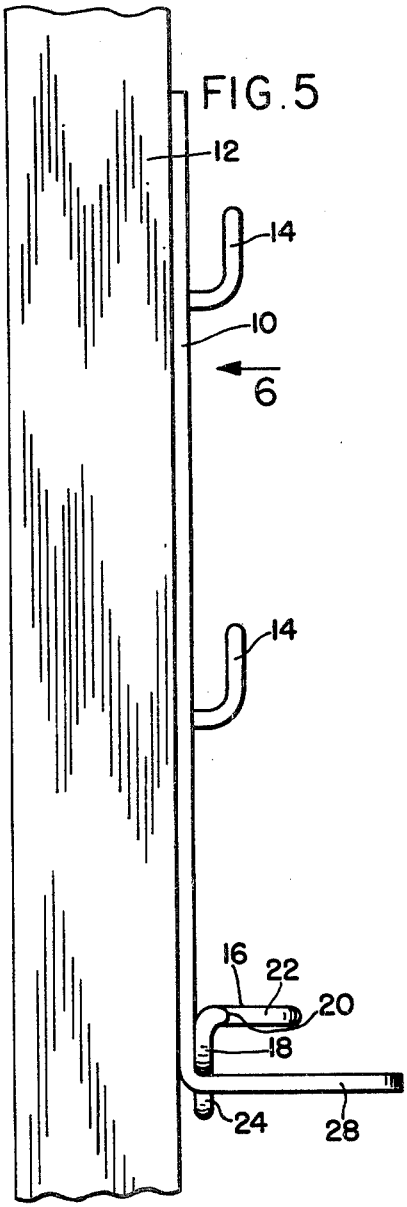
FIG. 5 is a side view of a corner post having a hook plate attached thereon and illustrating the angle iron mounted on the inturned tab.
Figure 6:
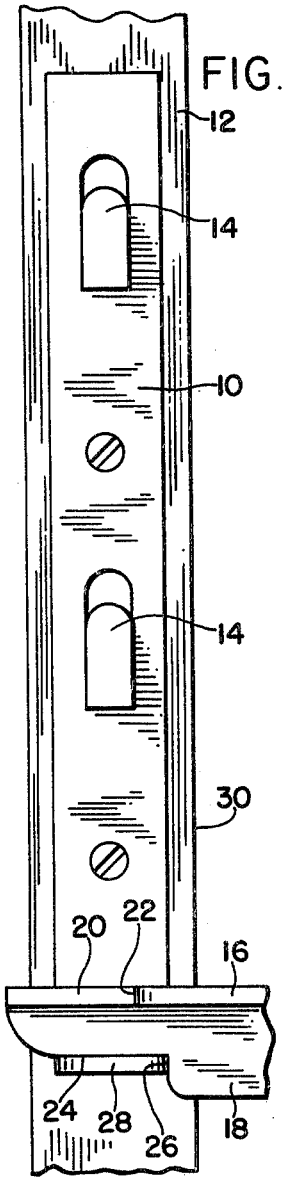
FIG. 6 is a view looking in the direction of arrow 6 in FIG. 5.
Figure 8:
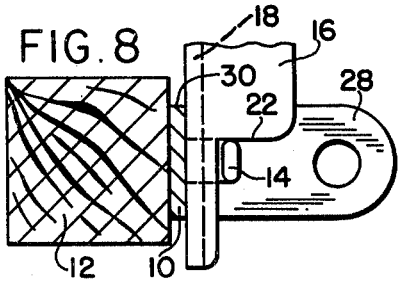
FIG. 8 is a section on line 8—8 of FIG. 7.

As shown in FIGS. 5 and 6 the angle iron can be supported on the inwardly directed tab 28 of the hook plate 10, the tab 28 as usual being apertured for the reception of the drop rod for the drop side of the crib, see FIG. 8. In this situation, this is the lowest possible adjustment of the crib spring and the recess at 24 rests upon the horizontal tab 28, the edge of the tab abutting the edge 26 of recess 24. The distance between the edge 26 at the left end of the angle iron and the edge 26 at the right-hand thereof defines the distance between the facing edges of tabs 28, and holds the crib spring against any lateral shifting; whereas, of course, the entire crib spring is held from longitudinal shifting by the abutment of the ends of the angle irons with respect to the end hook plates 10, see FIG. 5.

Figure 7:
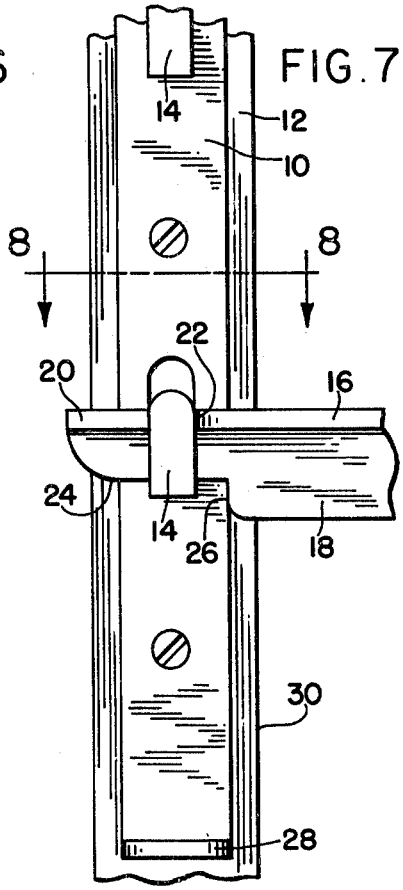
FIG. 7 is a view similar to FIG. 6 but showing the angle iron supported on a hook.

When it is desired to adjust the position of the crib spring the recesses 24 are disengaged from tabs 28 and this end of the spring is lifted up, and these ends are then placed in a selected hook 14. In this case the recess 20 with its edge 22 is located adjacent to the hook with edge 22 abutting the edge of the hook 14 which, of course, is inset as for instance shown in FIGS. 6 and 7 from the edge 30 of the hook plate 10. In this case the edge 26 of recess 24 coincides again with the edge 30 but it does not engage the same, the lateral motion of the crib spring being inhibited by abutment of the edge 22 of the recess 20 with the edge of the respective hook 14. The same is, of course, true when any other hook 14 is engaged by the ends of the angle iron as will be clear.

We claim:

1. The combination of a bedstead having end posts at the corners thereof, a vertical plate on each post, a series of vertically aligned and spaced hooks on each plate, and a supporting tab at the lower end of each plate, the hooks being narrower than the tab, with a spring support comprising an angle iron at each end of a spring, each angle iron having two flanges, a shorter recess at each end of one flange and a longer recess at each end of the other flange, the angle irons being selectively positioned on the tabs or on corresponding hooks, the shorter recesses fitting in the hooks, and the longer recesses including edges resting resting on the tabs.

2. The combination of claim 1 wherein the longer recesses include edges engaging the tabs in corresponding pairs, and the shorter recesses include edges engaging the hooks in corresponding pairs, thereby preventing lateral motion of the spring on its supports.

* * * * *